United States Patent [19]

Kovach

[11] 4,345,760

[45] Aug. 24, 1982

[54] EDUCATIONAL MARBLE GAME

[76] Inventor: John J. Kovach, 189 Landover, Gahanna, Ohio 43230

[21] Appl. No.: 153,174

[22] Filed: May 27, 1980

[51] Int. Cl.[3] ..... A63F 7/00

[52] U.S. Cl. ..... 273/118 R; 273/286

[58] Field of Search ..... 273/123, 286, 118 R, 273/108, 109; 434/150, 128, 130

[56] References Cited

U.S. PATENT DOCUMENTS

| | | | |
|---|---|---|---|
| 549,938 | 11/1895 | Sample | 273/123 |
| 1,325,104 | 12/1919 | Miller | 273/118 R |
| 1,506,979 | 9/1924 | Foulks | 273/1 A X |
| 1,597,562 | 8/1926 | Allen | 434/150 |
| 2,636,740 | 4/1953 | McNeal | 273/118 R |

OTHER PUBLICATIONS

"The Washington Star," Sunday Magazine Section, Jun. 25, 1967, p. 9.

*Primary Examiner*—George J. Marlo
*Attorney, Agent, or Firm*—Robert B. Watkins

[57] ABSTRACT

An educational marble game in which players project spherical playing pieces—marbles—on a textured game board carpet on which indicia are presented having unnamed geographical significance, such as a map of the United States, subdivided into the various subdivisions, such as states. By playing the game, the players enjoy the challenge of the manual dexterity of projecting the marbles along with the benefit of naming and learning geographical facts simultaneously and in combination.

6 Claims, 1 Drawing Figure

EDUCATIONAL MARBLE GAME

SUMMARY OF THE INVENTION

This invention relates to a game. More particularly, the invention relates to a game board and playing pieces which combine as apparatus for use in playing a game according to prescribed procedures and rules.

The game of this invention is educational in nature, combining the challenges of competition, manipulative and dexterity skills as well as a demonstration of the ability to recall knowledge about geographical facts.

The game is played upon a substantially smooth and flat surface with spherical playing pieces like marbles. The playing surface game board is inscribed with indicia in the general geographical configuration and significance of a political entity such as the United States or other country or state.

Marble games have been played for many years in a scheme wherein the players present marbles from their personally owned collection into an appointed target area. The various players take turns in knocking the marbles out by the means of shooter marbles which they project into the target area. Beyond this, similarity of marble games is quickly lost as many variations in rules and playing materials are practiced and used.

The objective of some marble games is to capture and win the possession and ownership of as many marbles as possible from those presented to the game from various players. Thus, the winner not only wins by numerically taking possession of the most marbles, but also becomes the possessor and owner of the marbles.

Marbles may be of any materials but are usually glass, although sometimes marbles are steel. The playing surface for marble games is preferrably a relatively flat surface, the composition of which may be a dry material such as compacted earth, textured carpeting, or artificial carpet grass upon which the marbles will roll. The surface should have some texture so that the marbles come to a stop by gravity and friction in a short space of a few meters.

In this invention, a new feature and advantage has been added which is the combination of a marble game with a playing surface on which unnamed geographical features are represented by indicia marked on the surface. In a preferred embodiment, the surface is a textured carpet which may be spread upon a floor or other substrate, such as in a school room.

It is an object of this invention that the marble game players learn geography while they are playing. It is a further object of the game that the marbles and the game board with the geographical indicia combine to make playing the game an educational experience and that their knowledge of geography shall be increased as they play the game.

In playing the marble game of this invention, the game board which is usually a portion of textured carpet having unnamed geographical indicia thereon, such as a map of the United States is spread upon the floor. Each player casts his portion of the target marbles into the subdivision, such as states of the geographical area.

After naming geographical facts from the subdivisions where target marbles are located, players project their shooter marbles into the area and endeavor to knock target marbles from indicated geographical subdivisions, such as from a state.

If a player is successful in knocking a target marble out of a geographical subdivision, such as out of a state, the player may take and keep that target marble as a score, and if the game is being played for keeps, the player may keep and own the marble. If the player can then name the geographical area where his shooter marble comes to a stop and if he can name the geographical area of another target marble, he may take another turn.

Because each player must be able to name the geographical areas where the target marbles are and the geographical areas where a shooter marble comes to a stop, it becomes a matter of educational skill as well as marble shooting dexterity to win the game.

A clearer understanding of the invention will be apparent from the following drawing and detailed description.

DETAILED DESCRIPTION OF THE INVENTION

Figure 1:
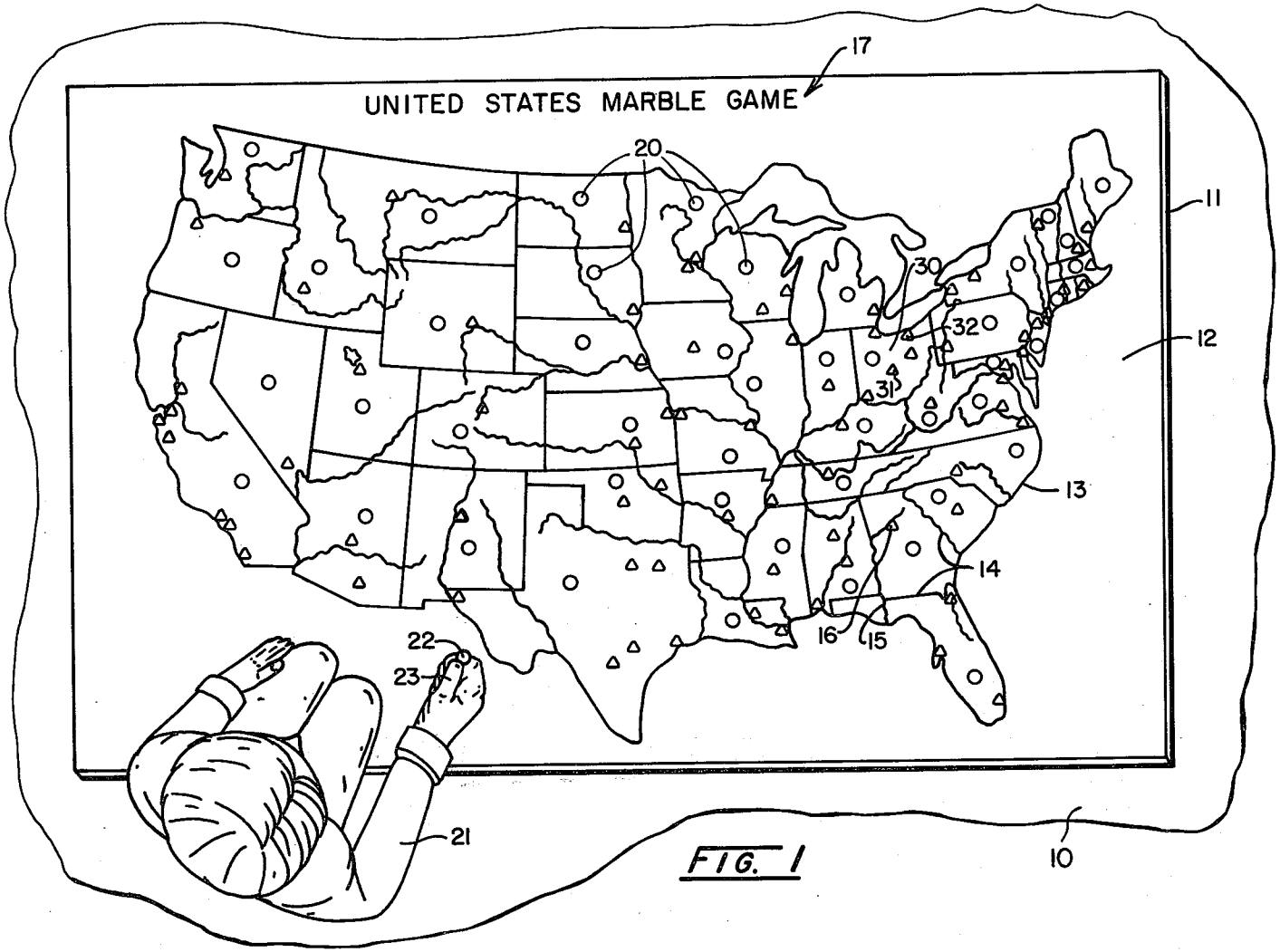
FIG. 1 is a plan view of the game apparatus of this invention, including a player in kneeling position to play the game.

Referring to FIG. 1, game board 11 which is supported upon a substrate 10 has a playing surface 12. Indicia 13 representing a map of geographical significance, such as the contour of the United States, is marked or impressed upon the playing surface 12. Other indicia 14 form the boundaries and confines of unnamed geographical subdivisions, such as states. Other important but unnamed geographical features, such as rivers 15 and cities 16, are also marked or impressed upon the playing surface 12. A suitable name 17 may be inscribed on surface 12 also.

On the game board 11, are placed spherical playing pieces 20, such as marbles. The game board is preferrably a piece of textured carpet having a surface hardness and roughness similar to packed earth but of a nature that will cause the marbles 20 to roll freely but come to a stop generally within the confines of the game board 11. A player 21, shown from overhead in the kneeling position, holds a shooter marble 22 in position to project it across the surface 12 by means of his thumb 23.

At the beginning of the game, players select the rotation of play, either by lagging a marble to an agreed target on the playing surface 12 such as the intersection of two states, or by flipping a coin or other means. All players agree to the number and kind of marbles each player is to use in the game. The marbles are dropped or placed in the unnamed states, one marble to a state.

The first player 21 selects and shoots at any marble 20 on the playing surface 12 from any position outside the perimeter of the map contour. Before shooting, the player 21 must name the state in which the target marble 20 is located. If the player misnames or fails to name the state occupied by the target marble, the player loses his turn. Having named the target marble and the state in which it rests, the player 21 shoots and attempts to hit the target marble out of the state in which it was located. He is permitted to keep that marble that he strikes out of the state and any marbles hit out of the states because of the reaction of his shot.

If the shooter marble remains within the border 13 of the United States after knocking a target marble from one state to the next, the player continues to shoot after he names the state where the shooter remains from the previous shot and the player names the state of his next target marble. If a player fails to knock a marble from the state named or fails to name the state of the target marble, the next player begins his turn.

If a player hits a marble other than the one which was designated as the target marble, the other marble is returned to its former position. The next player begins his turn.

The player who knocks the most marbles out of the states wins the game and may, at the option of the players, keep the marbles which he took during the game.

As an additional educational aspect of the game, each player may be required to name the capital city, the nearest metropolitan area or the nearest principle river or lake in the state where the target marble is located.

When the game is played using the knowledge of capitals, the player 21 designates the target marble 20, the state 14 in which it is located, and the capital 16 of that state. For instance, if the target marble is in the state of Ohio 30, Ohio is the state and Columbus 31 is the capital.

When the game is played using the knowledge of metropolitan areas, the player 21 designates the target marble 20, the state in which it is located 14, and the nearest metropolitan area in that state of the target marble. For instance, if the target marble is in the State of Ohio and it rests nearest to Cleveland 32, the state is Ohio 30 and the metropolitan area is Cleveland.

When the game is played using the knowledge of rivers and lakes, the player 21 designates the target marble, the state in which it is located, and the nearest river or lake, in or bordering the state where the target marble rests. For instance, if the target marble is in the state of Ohio and it rests nearer to the Ohio River than to Lake Erie, Ohio is the state and the Ohio River is the body of water.

It has been found preferable in the use of the game to provide a guide sheet or reference map upon which the same geographical representation map has been printed as that used with the indicia of the game board. The guide sheet also contains the printed names of the various subdivisions on the map and the names of the principal cities and the names of geographical features such as lakes and rivers. The guide sheet is used as a source of correct information whenever the players are in doubt or question the statement of the shooter player concerning the correct name of a subdivision or geographical feature.

Because of the indicia on the playing surface, a new educational dimension has been added to a marble game and because of the game action of marbles, the process of learning geography has been enhanced. Although the embodiment shown and disclosed is indicia representing the geographical contours of the United States of America, it will be apparent that the concept of the invention applies to other geographical subdivisions and their subdivisions. For instance, the map could be Europe with the countries of Europe as the subdivisions. The map could be a state of the United States and the subdivisions could be the counties thereof. The map could also be that of the world and the subdivisions could be the continents and countries thereof.

Of course, the rules may vary according to the wishes of the players.

The following U.S. patents provide further information about related games and are listed in accordance with 37 CFR Rule 1.56: U.S. Pat. Nos. 1,506,979; 2,636,740; 2,366,782; 3,231,278; and 4,179,122.

It is herein understood that although the present invention has been specifically disclosed with the preferred embodiments and examples, modifications and variations of the concepts herein disclosed, may be resorted to by those skilled in the art. Such modifications and variations are considered to be within the scope of the invention and the appended claims.

What is claimed is:

1. A game apparatus for teaching and learning geography, comprising:

a. a plurality of spherical playing pieces; and b. a game board playing surface, composed of a portable sheet of carpet material sufficiently hard and textured that the playing pieces will readily roll and stop thereon, the game board having indicia on the surface thereof, including a combination of assorted straight and curved lines joined together to form contours representing, defining, and depicting the shaped borders of enclosed areas of different contours of unnamed divisions or unnamed subdivisions of geographical significance, the spherical playing pieces being constructed to roll upon the playing surface of the game board by the projection of game players and to come to rest upon the surface of the game board within the shaped borders of the enclosed areas of the unnamed divisions or unnamed subdivisions and to strike other spherical playing pieces, and to propel them across the playing surface causing them to come to rest within or without the shaped borders of the enclosed areas of the unnamed divisions or unnamed subdivisions, and the game board being devoid of recesses capable of capturing the spherical playing pieces;

according to the rules and procedures of the game played upon the surface with the spherical playing pieces which allows the players to capture the spherical playing pieces according to skill in detecting the shape and naming the divisions or subdivisions in addition to skill in projecting the spherical playing pieces.

2. A game apparatus according to claim 1 wherein the spherical playing pieces comprise glass, plastic, or steel marbles.

3. A game apparatus according to claim 1 wherein the game board material is textured carpet.

4. A game apparatus according to claim 1 wherein the indicia represent geographical configurations of the contour of the United States of America and the confines of the states thereof.

5. A game apparatus according to claim 4 wherein the indicia also represent important rivers or lakes which are located within the geographical confines of the United States of America.

6. A game apparatus according to claim 5 wherein indicia also represent state capitals and important cities within the geographical confines of the United States of America.

* * * * *